US012085304B2

(12) United States Patent
Si et al.

(10) Patent No.: US 12,085,304 B2
(45) Date of Patent: Sep. 10, 2024

(54) AUXILIARY MOUNTING DEVICE AND MOUNTING METHOD FOR SADDLE-TYPE WINDOW AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Chuanling Si, Qingdao (CN); Wenquan Song, Qingdao (CN); Qiang Zhang, Qingdao (CN); Qiuxia He, Qingdao (CN); Ruofeng Wang, Qingdao (CN); Guangbao Qiao, Qingdao (CN)

(73) Assignees: Qingdao Haier Air Conditioner General Corp., Ltd., Shandong (CN); Haier Smart Home Co., Ltd., Shandong (CN)

( * ) Notice: Subject to any disclaimer, the term of this patent is extended or adjusted under 35 U.S.C. 154(b) by 369 days.

(21) Appl. No.: 17/609,513

(22) PCT Filed: Aug. 23, 2019

(86) PCT No.: PCT/CN2019/102173
§ 371 (c)(1),
(2) Date: Nov. 8, 2021

(87) PCT Pub. No.: WO2020/224096
PCT Pub. Date: Nov. 12, 2020

(65) Prior Publication Data

US 2022/0228771 A1 Jul. 21, 2022

(30) Foreign Application Priority Data

May 8, 2019 (CN) ..... 201910380311.8
May 8, 2019 (CN) ..... 201920651413.4

(51) Int. Cl.
*F24F 13/32* (2006.01)
*F24F 1/03* (2019.01)
*F24F 1/031* (2019.01)

(52) U.S. Cl.
CPC ..... *F24F 13/32* (2013.01); *F24F 1/031* (2019.02)

(58) Field of Classification Search
CPC .... F24F 1/027; F24F 1/03; F24F 1/031; F24F 13/32
See application file for complete search history.

(56) References Cited

U.S. PATENT DOCUMENTS 5,167,131 A 12/1992 Karkhanis
5,820,092 A 10/1998 Thaler
(Continued)

FOREIGN PATENT DOCUMENTS

CN 101041930 A 9/2007
CN 101876465 A 11/2010
(Continued)

OTHER PUBLICATIONS

International Search Report for PCT/CN2019/102173 (ISA/CN) mailed Feb. 10, 2020 with English translation (4 pages).
(Continued)

*Primary Examiner* — Marc E Norman
(74) *Attorney, Agent, or Firm* — Alston & Bird LLP

(57) ABSTRACT

Disclosed is an auxiliary mounting device and a mounting method for a saddle-type window air conditioner. Two groups of mutually connected L-shaped main supports and L-shaped auxiliary supports are included. Main transverse supports are connected with auxiliary transverse supports, an upper surface formed after the main transverse supports are connected with the auxiliary transverse supports is a plane, and a connecting part of a saddle-type window air conditioner is located on the plane. The main transverse supports and the auxiliary transverse supports can move
(Continued)

relative to each other, so that a distance between main vertical supports and auxiliary vertical supports is adjustable for adaptation to windows with different sizes, and that the applicability is strong. During mounting, the main transverse supports and the auxiliary transverse supports are located at an upper portion of a windowsill respectively, the main vertical supports are located on an outer side of a wall below the windowsill, and the auxiliary vertical supports are located on an inner side of the wall below the windowsill. Brackets are disposed on outer sides of the main vertical supports, clamping grooves are formed in a bottom plate of an outdoor part of the saddle-type window air conditioner, and the brackets are clamped in the clamping grooves, so that the saddle-type window air conditioner is more reliable and is unlikely to shake and tilt after mounted.

9 Claims, 6 Drawing Sheets

(56) References Cited

U.S. PATENT DOCUMENTS

| | | | | |
|---|---|---|---|---|
| 6,298,678 | B1 | 10/2001 | Kim | |
| 11,498,163 | B2 * | 11/2022 | Li | F24F 1/0003 |
| 2007/0068185 | A1 | 3/2007 | Thompson | |
| 2010/0270448 | A1 | 10/2010 | Boccia et al. | |
| 2013/0228536 | A1 | 9/2013 | Crowley | |
| 2020/0124296 | A1 * | 4/2020 | Baumann | F24F 1/027 |
| 2022/0205652 | A1 * | 6/2022 | Zhou | F24F 13/32 |
| 2022/0381475 | A1 * | 12/2022 | Lei | F24F 1/031 |

FOREIGN PATENT DOCUMENTS

| | | | |
|---|---|---|---|
| CN | 105485786 | A | 4/2016 |
| CN | 107559978 | A | 1/2018 |
| CN | 207729815 | U | 8/2018 |
| CN | 108679746 | A | 10/2018 |
| CN | 108954795 | A | 12/2018 |
| CN | 210220195 | U | 3/2020 |
| KR | 20030080778 | A | 10/2003 |

OTHER PUBLICATIONS

China Search Report for China Patent Application No. 2019103803118 dated Nov. 29, 2023 (6 pages).

1st Office Action for China Patent Application No. 2019103803118 dated Dec. 1, 2023 (10 pages).

* cited by examiner

AUXILIARY MOUNTING DEVICE AND MOUNTING METHOD FOR SADDLE-TYPE WINDOW AIR CONDITIONER

CROSS-REFERENCE TO RELATED APPLICATIONS

The present application is a national phase entry of International Application No. PCT/CN2019/102173, filed Aug. 23, 2019, which claims priority to Chinese Patent Application No. 201910355402.6, and Chinese Patent Application No. 201910380311.8, each filed May 8, 2019, and which are incorporated herein by reference in their entirety.

FIELD OF THE INVENTION

The present invention relates to the technical field of air conditioners, and particularly to an auxiliary mounting device and a mounting method for a saddle-type window air conditioner.

BACKGROUND OF THE INVENTION

Compared with an ordinary window air conditioner, a saddle-type window air conditioner is more difficult to mount due to its special shape. A windowsill is a non-plane, while a mounting position of the saddle-type window air conditioner needs to be a plane. Therefore, a mechanism is needed to transform the non-plane into a plane and fix the plane on the windowsill to facilitate mounting of the saddle-type window air conditioner.

BRIEF DESCRIPTION OF THE INVENTION

Technical Problem

In order to solve the foregoing technical problem, the present invention provides an auxiliary mounting device and a mounting method for a saddle-type window air conditioner. The auxiliary mounting device can transform a non-plane of a windowsill into a plane that facilitates mounting of the saddle-type window air conditioner, and it is simple in structure and high in reliability.

Technical Solution

The present invention provides the following technical solutions: An auxiliary mounting device for a saddle-type window air conditioner is configured to assist in mounting the saddle-type window air conditioner, and includes two groups of mutually connected L-shaped main supports and L-shaped auxiliary supports. The main support includes a main transverse support and a main vertical support, and the auxiliary support includes an auxiliary transverse support and an auxiliary vertical support. The main transverse support is connected with the auxiliary transverse support, and an upper surface formed after the main transverse support is connected with the auxiliary transverse support is a plane. A distance between the main vertical support and the auxiliary vertical support is adjustable. The main transverse support and the auxiliary transverse support are located at an upper portion of a windowsill respectively. The main vertical support is located on an outer side of a wall below the windowsill, and the auxiliary vertical support is located on an inner side of the wall below the windowsill. A bracket is disposed on an outer side of the main vertical support, a clamping groove is formed in a bottom plate of an outdoor part of the saddle-type window air conditioner, and the bracket is clamped in the clamping groove. A connecting part of the saddle-type window air conditioner is located at upper portions of the main transverse support and the auxiliary transverse support.

Further, a descent control component is disposed on the main support. The descent control component includes the bracket, a pressing plate, a steel wire rope, a spring, and a bearing. The spring is disposed on the main vertical support along a vertical direction. The bearing is disposed at a corner of the main support. The steel wire rope is wound on the bearing. One end of the steel wire rope is connected with the spring, and the other end of the steel wire rope is connected with the pressing plate or the bracket. The pressing plate is connected with the bracket. A gap is formed between the pressing plate and the bracket. The main vertical support is provided with a long-strip opening along a height direction thereof. The gap is clamped to a sidewall of the opening. The bracket and the pressing plate move up and down along the sidewall of the opening.

Further, a pin hole is formed in the corner of the main support, a cylindrical pin passes through and is disposed in the pin hole, and the bearing is sleeved on the cylindrical pin.

Further, a clamping hook is disposed on the main vertical support, and one end of the spring is clamped with the clamping hook.

Further, a flat connecting portion is disposed at one end of the steel wire rope, a groove is formed in the pressing plate or the bracket, and the connecting portion is clamped in the groove.

Further, first flangings facing an inner side of the main support are formed on two sides of the main support, and the first flangings on the main transverse support are provided with a plurality of long-strip first through holes along a length direction thereof. Second flangings facing an outer side of the auxiliary support are formed on two sides of the auxiliary support, and the second flangings on the auxiliary transverse support are provided with a plurality of first screw holes along a length direction thereof. Screws simultaneously pass through and are disposed in the first through holes and the first screw holes.

Further, a windowsill pressing plate is disposed between the two main supports. The windowsill pressing plate includes a horizontal portion and a vertical portion. The horizontal portion abuts against the windowsill. Two ends of the vertical portion are connected with the main vertical support respectively.

Further, the first flangings on the two sides of the main vertical support are provided with a plurality of second screw holes along a height direction thereof. The two ends of the vertical portion are respectively provided with two connecting plates arranged at intervals. Long-strip second through holes are formed in the connecting plate. Screws pass through and are disposed in the second through holes and the second screw holes.

Further, a lower guide rail is disposed between the two auxiliary transverse supports. Curtain-drawing frames are inserted to two sides of the lower guide rail respectively. The curtain-drawing frames move along the lower guide rail. End portions of the curtain-drawing frames are connected with a sidewall of a window.

Further, a first adjusting screw passes through and is disposed at a free end portion of the main vertical support, and the first adjusting screw abuts against the outer side of the wall below the windowsill. A second adjusting screw passes through and is disposed at a free end portion of the auxiliary vertical support, and the second adjusting screw abuts against the inner side of the wall below the windowsill.

The present invention further provides a method for mounting a saddle-type window air conditioner. The mounting method uses the above-mentioned auxiliary mounting device for a saddle-type window air conditioner, and includes the following mounting steps:

(1) stretching a length size of the connecting part of the saddle-type window air conditioner to adjust a distance between an indoor part and an outdoor part of the saddle-type window air conditioner to a maximum size, and placing the outdoor part at the upper portions of the main transverse support and the auxiliary transverse support;

(2) pushing the saddle-type window air conditioner towards an outdoor direction until the clamping groove in a lower portion of the bottom plate of the outdoor part is clamped with the bracket;

(3) causing the outdoor part to descend to a proper position slowly along with the bracket, and causing the connecting part to abut against upper surfaces of the main transverse support and the auxiliary transverse support at this time; and (4) reducing the length size of the connecting part of the saddle-type window air conditioner to cause the indoor part of the saddle-type window air conditioner to abut against the auxiliary vertical support.

Beneficial Effects

The present invention provides the auxiliary mounting device and the mounting method for a saddle-type window air conditioner. The auxiliary iii mounting device includes two groups of mutually connected L-shaped main supports and L-shaped auxiliary supports. The main transverse support is connected with the auxiliary transverse support, the upper surface formed after the main transverse support is connected with the auxiliary transverse support is a plane, and the connecting part of the saddle-type window air conditioner is located on the plane. The main transverse support and the auxiliary transverse support can move relative to each other, so that the distance between the main vertical support and the auxiliary vertical support is adjustable for adaptation to windows with different sizes, and that the applicability is strong. During mounting, the main transverse support and the auxiliary transverse support are located at the upper portion of the windowsill respectively, the main vertical support is located on the outer side of the wall below the windowsill, and the auxiliary vertical support is located on the inner side of the wall below the windowsill. The bracket is disposed on the outer side of the main vertical support, the clamping groove is formed in the bottom plate of the outdoor part of the saddle-type window air conditioner, and the bracket is clamped in the clamping groove, so that the saddle-type window air conditioner is more reliable and is unlikely to shake and tilt after mounted.

BRIEF DESCRIPTION OF THE DRAWINGS

To describe the technical solutions in the embodiments of the present invention or in the prior art clearly, the following briefly describes the accompanying drawings required for describing the embodiments or the prior art. Apparently, the accompanying drawings in the following description show some embodiments of the present invention, and those of ordinary skill in the art may still derive other drawings from these accompanying drawings without creative efforts.

Figure 1:
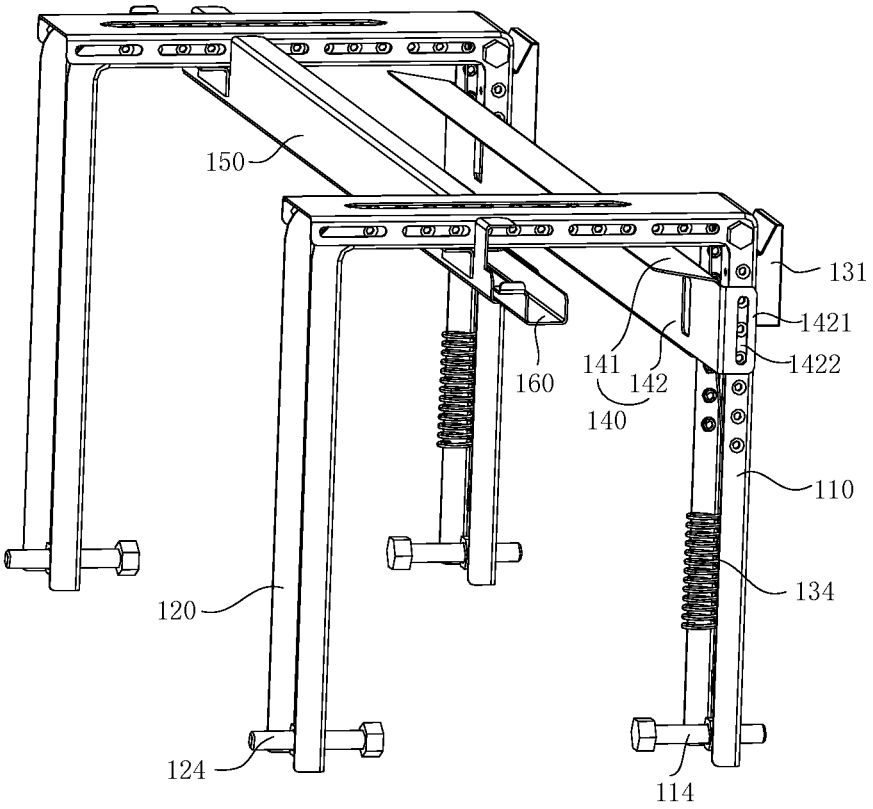
FIG. 1 is a schematic structural diagram of an auxiliary mounting device for a saddle-type window air conditioner according to an embodiment of the present invention.

In the figures: 100 denotes an auxiliary mounting device; 110 denotes a main support; 111 denotes a main transverse support; 112 denotes a main vertical support; 1121 denotes an opening; 1122 denotes a clamping hook; 113 denotes a first flanging; 1131 denotes a first through hole; 1132 denotes a second screw hole; 114 denotes a first adjusting screw; 115 denotes a pin hole; 120 denotes an auxiliary support; 121 denotes an auxiliary transverse support; 122 denotes an auxiliary vertical support; 123 denotes a second flanging; 1231 denotes a first screw hole; 124 denotes a second adjusting screw; 130 denotes a descent control component; 131 denotes a bracket; 132 denotes a pressing plate; 1321 denotes a groove; 133 denotes a steel wire rope; 1331 denotes a connecting portion; 134 denotes a spring; 135 denotes a bearing; 136 denotes a cylindrical pin; 140 denotes a windowsill pressing plate; 141 denotes a horizontal portion; 142 denotes a vertical portion; 1421 denotes a connecting plate; 1422 denotes a second through hole; 150 denotes a lower guide rail; 160 denotes a curtain-drawing frame; 200 denotes a saddle-type window air conditioner; 210 denotes an indoor part; 220 denotes an outdoor part; 221 denotes a bottom plate; 2211 denotes a clamping groove; and 230 denotes a connecting part.

DETAILED DESCRIPTION

In order to make objectives, technical solutions and advantages of embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. All other embodiments obtained by those of ordinary skill in the art based on the embodiments of the present invention without creative efforts shall fall within the protection scope of the present invention.

The present invention discloses an auxiliary mounting device for a saddle-type window air conditioner, which is configured to assist in mounting the saddle-type window air conditioner. The saddle-type window air conditioner 200 includes an indoor part 210, an outdoor part 220 and a connecting part 230. The connecting part 230 is used to connect the indoor part 210 together with the outdoor part 220. The auxiliary mounting device 100 is mounted on a windowsill, and the connecting part 230 is located on the auxiliary mounting device 100. According to the embodiment, the auxiliary mounting device 100 is structurally improved to mount the saddle-type window air conditioner 200.

Figure 2:
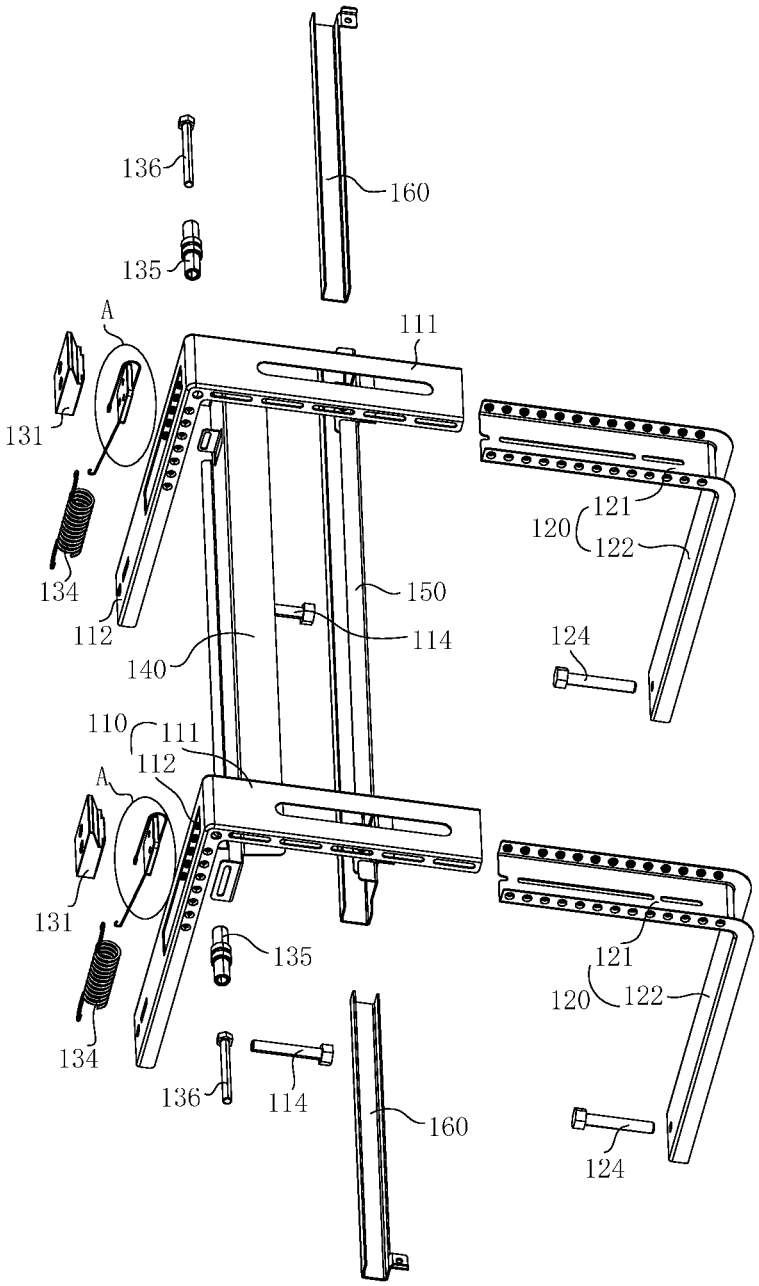
FIG. 2 is a schematic diagram of an assembly structure of an auxiliary mounting device for a saddle-type window air conditioner according to an embodiment of the present invention.
Figure 4:
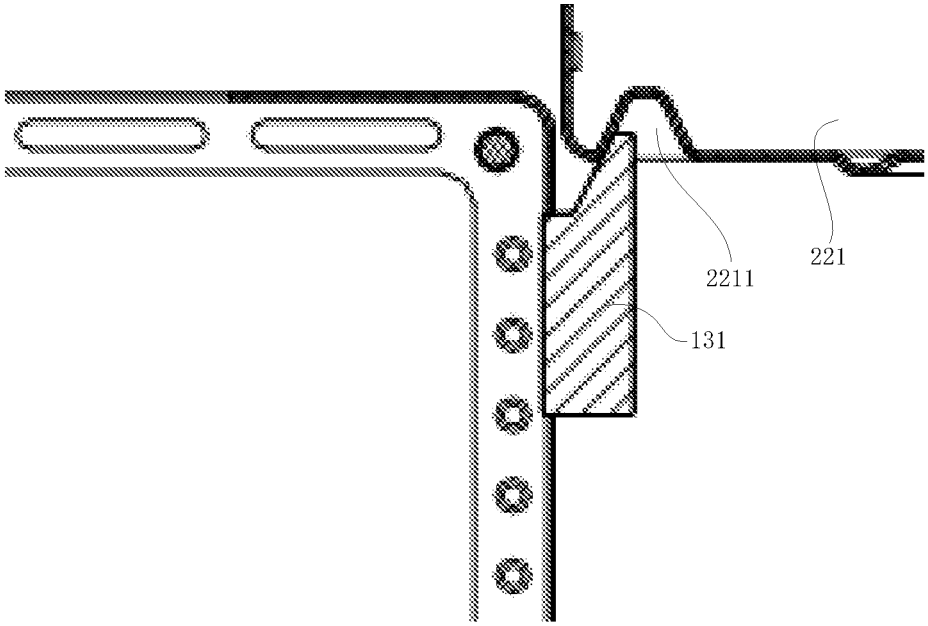
FIG. 4 is a schematic diagram of a mating structure between a bracket and a bottom plate of an outdoor part according to an embodiment of the present invention.

Referring to FIGS. 1 and 2, the auxiliary mounting device 100 includes two groups of mutually connected L-shaped main supports 110 and L-shaped auxiliary supports 120. The main support 110 includes a main transverse support 111 and a main vertical support 112. The auxiliary support 120 includes an auxiliary transverse support 121 and an auxiliary vertical support 122. The main transverse support 111 is connected with the auxiliary transverse support 121, and an upper surface formed after the main transverse support 111 is connected with the auxiliary transverse support 121 is a plane, so that a non-plane on the windowsill is transformed into a plane. The connecting part 230 is located on the plane. The main transverse support 111 and the auxiliary transverse support 121 can move relative to each other, so that a distance between the main vertical support 112 and the auxiliary vertical support 122 is adjustable for adaptation to windows with different sizes, and that the applicability is strong. During mounting, the main transverse support 111 and the auxiliary transverse support 121 are located at an upper portion of the windowsill respectively, the main vertical support 112 is located on an outer side of a wall below the windowsill, and the auxiliary vertical support 122 is located on an inner side of the wall below the windowsill. Referring to FIG. 4, a bracket 131 is disposed on an outer side of the main vertical support 112, a clamping groove 2211 is formed in a bottom plate 221 of the outdoor part 220 of the saddle-type window air conditioner 200, and the bracket 131 is clamped in the clamping groove 2211, so that the saddle-type window air conditioner 200 is more reliable and is unlikely to shake and tilt after mounted.

Figure 9:
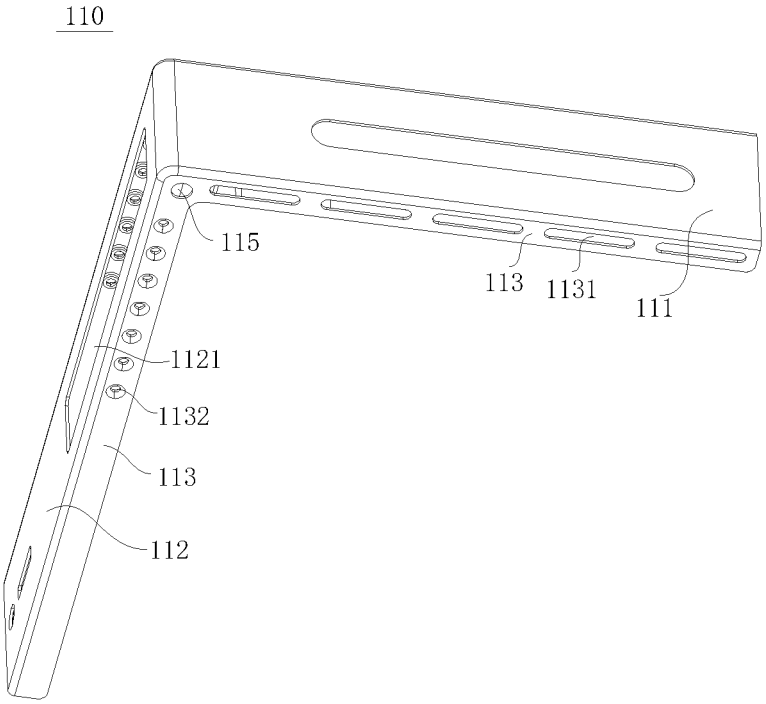
FIG. 9 is a schematic structural diagram of a main support according to an embodiment of the present invention.
Figure 10:
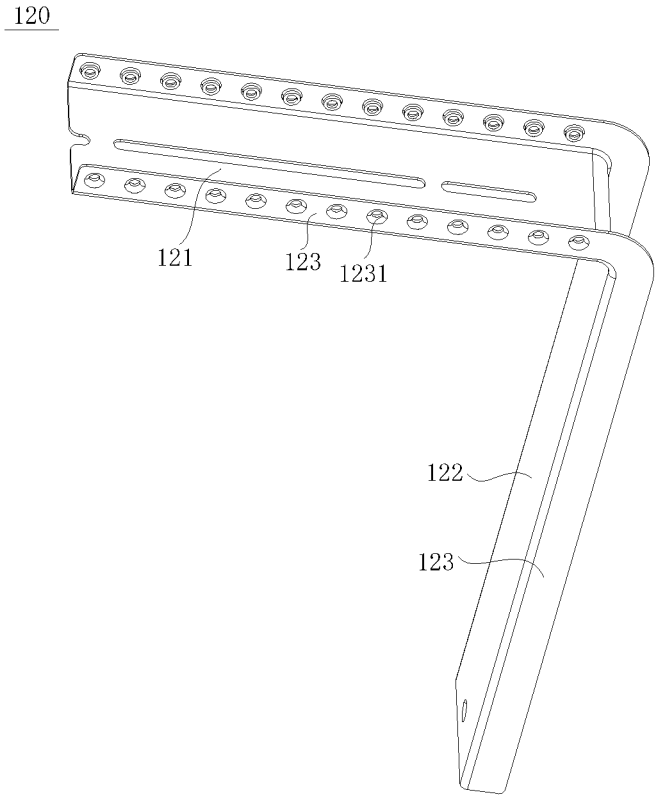
FIG. 10 is a schematic structural diagram of an auxiliary support according to an embodiment of the present invention.

Referring to FIG. 9, first flangings 113 facing an inner side of the main support 110 are formed on two sides on the main support 110, that is, the first flangings 113 on two sides of the main transverse support 111 face a direction of the main vertical support 112, and the first flangings 113 on two sides of the main vertical support 112 face a direction of the main transverse support 111. Contrary to the main support 110, referring to FIG. 10, second flangings 123 facing an outer side of the auxiliary support 120 are formed on two sides on the auxiliary support 120, that is, the second flangings 123 on two sides of the auxiliary transverse support 121 deviate from a direction of the auxiliary vertical support 122, and the second flangings 123 on two sides of the auxiliary vertical support 122 deviate from a direction of the auxiliary transverse support 121. The first flangings 113 on the main transverse support 111 are provided with a plurality of long-strip first through holes 1131 along a length direction thereof, the second flangings 123 on the auxiliary transverse support 121 are provided with a plurality of first screw holes 1231 along a length direction thereof, and screws (not shown in the figures) simultaneously pass through and are disposed in the first through holes 1131 and the first screw holes 1231 to implement fixed connection between the main transverse support 111 and the auxiliary transverse support 121. Mounting positions of the screws in the first through holes 1131 and the first screw holes 1231 are adjusted to implement relative movement between the main transverse support 111 and the auxiliary transverse support 121, so that the distance between the main vertical support 112 and the auxiliary vertical support 122 is adjustable. After the main transverse support 111 is fixedly connected with the auxiliary transverse support 121, the second flanging 123 on the auxiliary transverse support 121 abuts against an inner side of the first flanging 113 on the main transverse support 111.

Figure 3:
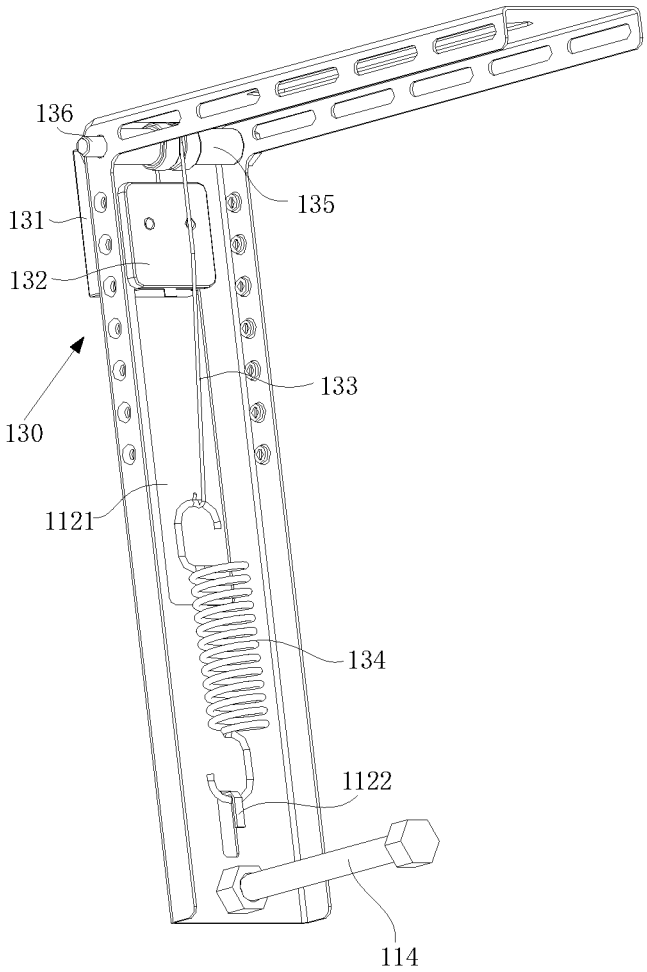
FIG. 3 is a schematic structural diagram of a main support and a descent control component according to an embodiment of the present invention.

Referring to FIGS. 2 and 3, a descent control component 130 is disposed on the main support 110. The descent control component 130 includes the bracket 131, a pressing plate 132, a steel wire rope 133, a spring 134, and a bearing 135. The spring 134 is disposed at a lower position of the main vertical support 122 along a vertical direction. For attractive appearance, the spring 134 is disposed on an inner side of the main vertical support 122. The bearing 135 is disposed at a corner of the main support 110, i.e., a junction of the main transverse support 111 and the main vertical support 112. The steel wire rope 133 is wound on the bearing 135. Meanwhile, one end of the steel wire rope 133 is fixedly connected with the spring 134, and the other end of the steel wire rope 133 is fixedly connected with the pressing plate 132 or the bracket 131. The pressing plate 132 is fixedly connected with the bracket 131 through the screws, and after the pressing plate 132 is fixedly connected with the bracket 131, a gap (not shown in the figures) is formed therebetween. The main vertical support 112 is provided with a long-strip opening 1121 along a height direction thereof. The gap between the pressing plate 132 and the bracket 131 is clamped to a sidewall of the opening 1121. The bracket 131 and the pressing plate 132 can simultaneously move up and down along the sidewall of the opening 1121.

It is to be noted that, when the spring 134 is in a return state, the bracket 131 is located at an upper position of the main vertical support 112.

Figure 5:
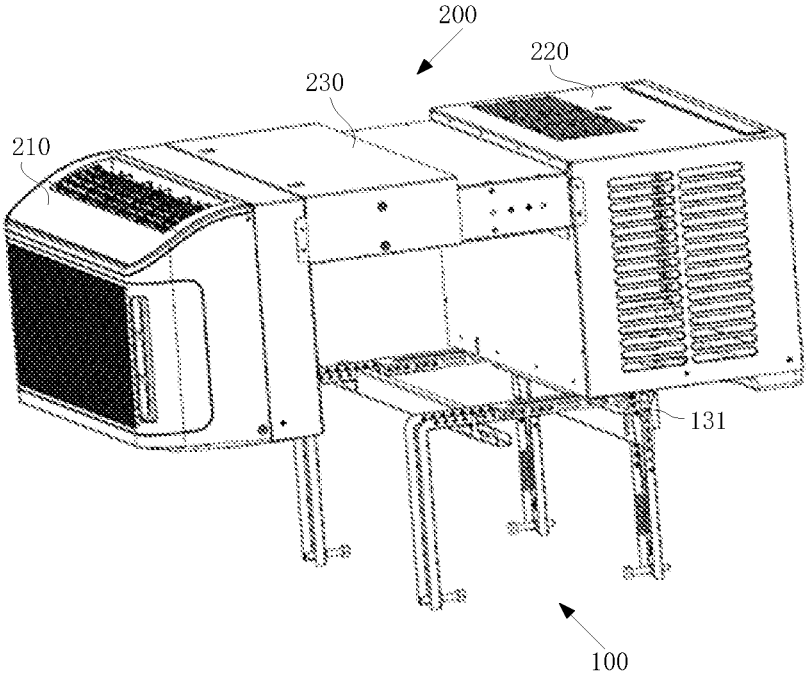
FIG. 5 is a schematic structural diagram of mounting step I using an auxiliary mounting device for a saddle-type window air conditioner according to an embodiment of the present invention.

After the auxiliary mounting device 100 is fixedly mounted on the windowsill, the saddle-type window air conditioner 200 is mounted through the following main steps:

(1) Referring to FIG. 5, the connecting part 230 of the saddle-type window air conditioner 200 is adjusted to adjust a distance between the indoor part 210 and outdoor part 220 of the saddle-type window air conditioner 200 to a maximum size, and the outdoor part 220 is placed at upper portions of the main transverse supports 111 and the auxiliary transverse supports 121.

Figure 6:
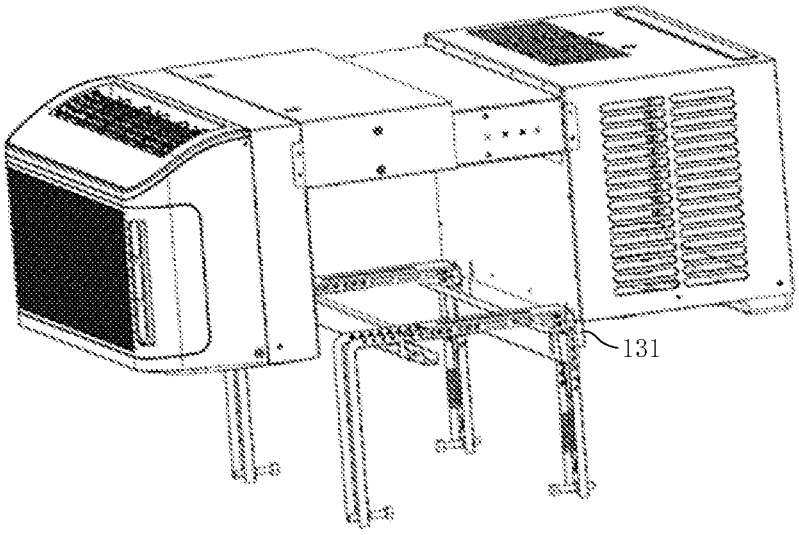
FIG. 6 is a schematic structural diagram of mounting step II using an auxiliary mounting device for a saddle-type window air conditioner according to an embodiment of the present invention.

(2) Referring to FIG. 6, the saddle-type window air conditioner 200 is pushed towards an outdoor direction until the clamping grooves 2211 in a lower portion of the bottom plate 221 of the outdoor part 220 are clamped with the brackets 131.

Figure 7:
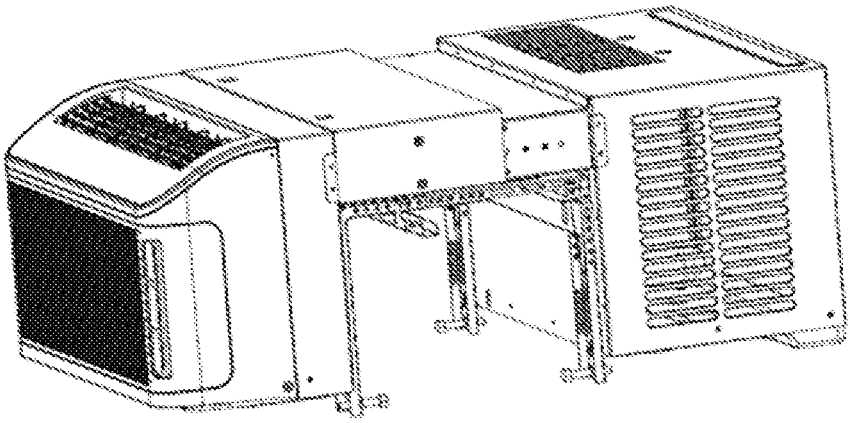
FIG. 7 is a schematic structural diagram of mounting step III using an auxiliary mounting device for a saddle-type window air conditioner according to an embodiment of the present invention.

(3) Referring to FIG. 7, the outdoor part 220 will move downwards under the action of gravity to drive the brackets 131 to move downwards, and under the action of tensile forces of the springs 134, the brackets 131 will descend slowly through the steel wire ropes 133 until the outdoor part 220 descends slowly to a proper position. In such case, the connecting part 230 abuts against upper surfaces of the main transverse supports 111 and the auxiliary transverse supports 121.

(4) A length size of the connecting part 230 of the saddle-type window air conditioner 200 is reduced, so that the indoor part 210 abuts against the auxiliary vertical supports 122. So far, the mounting is completed.

A pin hole 115 is formed in the corner of the main support 110, a cylindrical pin 136 passes through and is disposed in the pin hole 115, and the bearing 135 is sleeved on the cylindrical pin 136. The bearing 135 rotates about the cylindrical pin 136, to facilitate a sliding motion of the steel wire rope 133.

A clamping hook 1122 is disposed on the main vertical support 112, the clamping hook 1122 being opened downwards, and one end of the spring 134 is clamped with the clamping hook 1122. The structure is simple, and convenient for mounting.

Figure 8:
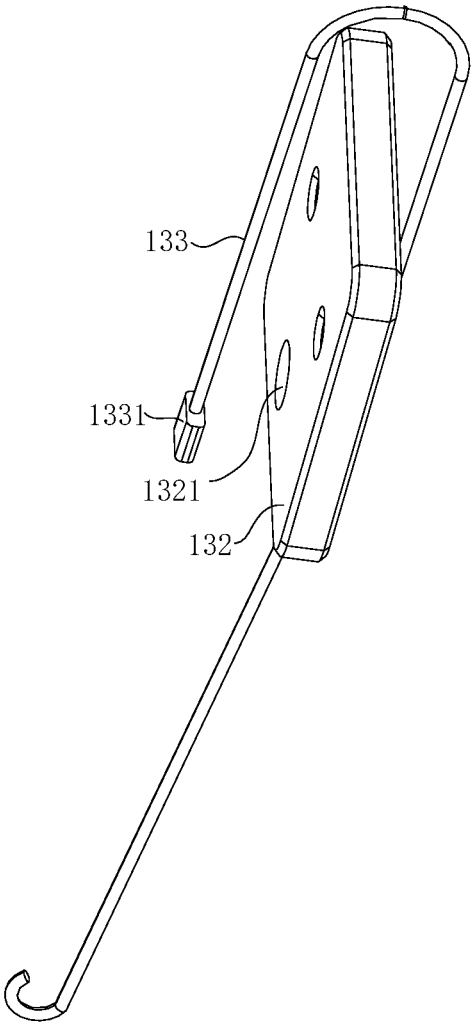
FIG. 8 is a partial enlarged view of A in FIG. 2.

Referring to FIG. 8, a flat connecting portion 1331 is disposed at one end of the steel wire rope 133, a groove 1321 is formed in the pressing plate 132, and the connecting portion 1331 is clamped in the groove 1321. After the pressing plate 132 is fixedly connected with the bracket 131, the connecting portion 1331 is limited between the pressing plate 132 and the bracket 131 to implement fixed connection and ensure a low separation rate. Of course, in other embodiments, the groove 1321 may be formed in the bracket 131, and in such case, the same effect can be achieved.

A windowsill pressing plate 140 is disposed between the two main supports 110. The windowsill pressing plate 140 is of an L-shaped structure, and includes a horizontal portion 141 and a vertical portion 142 that are mutually connected. The horizontal portion 141 abuts against the windowsill. Two ends of the vertical portion 142 are connected with the main vertical supports 112 respectively. Mounting positions of the two ends of the vertical portion 142 on the main vertical supports 112 are related to a height of a window frame. Before the windowsill pressing plate 140 is mounted, the height of the window frame needs to be measured at first to ensure that the main transverse supports 111 are located at an upper portion of the window frame.

The first flangings 113 on the two sides of the main vertical support 112 are provided with a plurality of second screw holes 1132 along the height direction thereof. The two ends of the vertical portion 142 are respectively provided with two connecting plates 1421 arranged at intervals. Long-strip second through holes 1422 are formed in the connecting plate 1421. Screws pass through and are disposed between the second through holes 1422 and the second screw holes 1132, to implement fixed connection between the windowsill pressing plate 140 and the main vertical support 112. Mounting positions of the screws in the second through holes 1422 and the second screw holes 1131 are adjusted to adjust a mounting position of the windowsill pressing plate 140 for adaptation to window frames of different heights, so that the applicability is strong.

A lower guide rail 150 is disposed between the two auxiliary transverse supports 121. Curtain-drawing frames 160 are inserted to two sides of the lower guide rail 150 respectively. The curtain-drawing frames 160 move along the lower guide rail 150. An end portion of the curtain-drawing frame 160 is fixedly connected with a sidewall of a window through screws. The lower guide rail 150 is fixedly connected with the auxiliary transverse support 121 through screws.

A first adjusting screw 114 passes through and is disposed at a free end portion of the main vertical support 112, and the first adjusting screw 114 abuts against the outer side of the wall below the windowsill. A second adjusting screw 124 passes through and is disposed at a free end portion of the auxiliary vertical support 122, and the second adjusting screw 124 abuts against the inner side of the wall below the windowsill.

The auxiliary mounting device 100 of the embodiment is assembled through the following steps:

(1) The descent control components 130 are mounted to the main supports 110.

(2) A thickness size of the windowsill is measured, and the main transverse supports 111 are fixedly connected with the auxiliary transverse supports 121 through screws according to the thickness size of the windowsill to make the distance between the main vertical support 112 and the auxiliary vertical support 122 equal to or slightly greater than the thickness size of the windowsill.

(3) The height of the window frame is measured, and the windowsill pressing plate 140 is fixedly mounted to the main vertical supports 112 through screws according to the height of the window frame to ensure that the main transverse supports 111 are located at the upper portion of the window frame.

(4) The lower guide rail 150 is fixedly mounted to lower portions of the auxiliary transverse supports 121 through screws.

(5) The two curtain-drawing frames 160 are inverted to two ends of the lower guide rail 150 respectively.

(6) A distance between an outer sidewall and the windowsill is measured, and the first adjusting screws 114 are adjusted to proper positions according to the distance. It should be understood here that the outer sidewall retracts in the windowsill, and when the distance between the main vertical support 112 and the auxiliary vertical support 122 is equal to the thickness size of the windowsill, an extending size of the first adjusting screw 114 relative to the main vertical support 112 is equal to a retracting size of the outer sidewall relative to the windowsill.

(7) The auxiliary mounting device 100 is placed on the windowsill, the main transverse supports 111 are located on the window frame, the main vertical supports 112 are located on an outdoor side, and the second adjusting screws 124 are adjusted to abut against an indoor sidewall. So far, assembling of the auxiliary mounting device 100 is completed.

It should be illustrated finally that, the above embodiments are only used for illustrating the technical solutions of the present invention, and are not intended to limit the present invention. Although the present invention is illustrated in detail with reference to the foregoing embodiments, it should be understood by those skilled in the art that, modifications may still be made on the technical solutions recited in the foregoing embodiments, or equivalent replacements are made on part of the technical features; and these modifications or replacements do not make the essence of the corresponding technical solutions break away from the spirit and scope of the technical solution of the various embodiments of the present invention.

The invention claimed is:

1. An auxiliary mounting device for a saddle-type window air conditioner, configured to assist in mounting the saddle-type window air conditioner, wherein the auxiliary mounting device comprises two groups of mutually connected L-shaped main supports and L-shaped auxiliary supports; the main support comprises a main transverse support and a main vertical support, and the auxiliary support comprises an auxiliary transverse support and an auxiliary vertical support; the main transverse support is connected with the auxiliary transverse support, and an upper surface formed after the main transverse support is connected with the auxiliary transverse support is a plane; a distance between the main vertical support and the auxiliary vertical support is adjustable; the main transverse support and the auxiliary transverse support are located at an upper portion of a windowsill respectively; the main vertical support is located on an outer side of a wall below the windowsill, and the auxiliary vertical support is located on an inner side of the wall below the windowsill; a bracket is disposed on an outer side of the main vertical support, a clamping groove is formed in a bottom plate of an outdoor part of the saddle-type window air conditioner, and the bracket is clamped in the clamping groove; and a connecting part of the saddle-type window air conditioner is located at upper portions of the main transverse support and the auxiliary transverse support, wherein a descent control component is disposed on the main support; the descent control component comprises the bracket, a pressing plate, a steel wire rope, a spring, and a bearing; the spring is disposed on the main vertical support along a vertical direction; the bearing is disposed at a corner of the main support; the steel wire rope is wound on the bearing; one end of the steel wire rope is connected with the spring, and the other end of the steel wire rope is connected with the pressing plate or the bracket; the pressing plate is connected with the bracket; a gap is formed between the pressing plate and the bracket; the main vertical support is provided with a long-strip opening along a height direction thereof; the gap is clamped to a sidewall of the opening; and the bracket and the pressing plate move up and down along the sidewall of the opening.

2. The auxiliary mounting device for a saddle-type window air conditioner according to claim 1, wherein a pin hole is formed in the corner of the main support, a cylindrical pin passes through and is disposed in the pin hole, and the bearing is sleeved on the cylindrical pin.

3. The auxiliary mounting device for a saddle-type window air conditioner according to claim 2, wherein a flat connecting portion is disposed at one end of the steel wire rope, a groove is formed in the pressing plate or the bracket, and the connecting portion is clamped in the groove.

4. The auxiliary mounting device for a saddle-type window air conditioner according to claim 1, wherein first flangings facing an inner side of the main support are formed on two sides of the main support, and the first flangings on the main transverse support are provided with a plurality of long-strip first through holes along a length direction thereof; second flangings facing an outer side of the auxiliary support are formed on two sides of the auxiliary support, and the second flangings on the auxiliary transverse support are provided with a plurality of first screw holes along a length direction thereof; and screws simultaneously pass through and are disposed in the first through holes and the first screw holes.

5. The auxiliary mounting device for a saddle-type window air conditioner according to claim 4, wherein a windowsill pressing plate is disposed between the two main supports, the windowsill pressing plate comprises a horizontal portion and a vertical portion, the horizontal portion abuts against the windowsill, and two ends of the vertical portion are connected with the main vertical support respectively.

6. The auxiliary mounting device for a saddle-type window air conditioner according to claim 5, wherein the first flangings on the two sides of the main vertical support are provided with a plurality of second screw holes along a height direction thereof, the two ends of the vertical portion are respectively provided with two connecting plates arranged at intervals, long-strip second through holes are formed in the connecting plate, and screws pass through and are disposed between the second through holes and the second screw holes.

7. The auxiliary mounting device for a saddle-type window air conditioner according to claim 1, wherein a lower guide rail is disposed between the two auxiliary transverse supports, curtain-drawing frames are inserted to two sides of the lower guide rail respectively, the curtain-drawing frames move along the lower guide rail, and end portions of the curtain-drawing frames are connected with a sidewall of a window.

8. The auxiliary mounting device for a saddle-type window air conditioner according to claim 1, wherein a first adjusting screw passes through and is disposed at a free end portion of the main vertical support, and the first adjusting screw abuts against the outer side of the wall below the windowsill; and a second adjusting screw passes through and is disposed at a free end portion of the auxiliary vertical support, and the second adjusting screw abuts against the inner side of the wall below the windowsill.

9. A mounting method for a saddle-type window air conditioner, wherein the mounting method uses the auxiliary mounting device for a saddle-type window air conditioner according to claim 1, and comprises the following mounting steps:

(1) stretching a length size of the connecting part of the saddle-type window air conditioner to adjust a distance between an indoor part and an outdoor part of the saddle-type window air conditioner to a maximum size, and placing the outdoor part at the upper portions of the main transverse support and the auxiliary transverse support;

(2) pushing the saddle-type window air conditioner towards an outdoor direction until the clamping groove in a lower portion of the bottom plate of the outdoor part is clamped with the bracket;

(3) causing the outdoor part to descend to a proper position along with the bracket, and causing the connecting part to abut against upper surfaces of the main transverse support and the auxiliary transverse support at this time; and (4) reducing the length size of the connecting part of the saddle-type window air conditioner to cause the indoor part of the saddle-type window air conditioner to abut against the auxiliary vertical support.

* * * * *